US008752231B1

(12) United States Patent
Asta

(10) Patent No.: US 8,752,231 B1
(45) **Date of Patent: *Jun. 17, 2014**

(54) HAIR BRUSH WITH SLIDEABLE BRUSH HEAD

(71) Applicant: Mary Asta, Naples, FL (US)

(72) Inventor: Mary Asta, Naples, FL (US)

( * ) Notice: Subject to any disclaimer, the term of this patent is extended or adjusted under 35 U.S.C. 154(b) by 0 days.

This patent is subject to a terminal disclaimer.

(21) Appl. No.: 13/692,288

(22) Filed: Dec. 3, 2012

Related U.S. Application Data

(62) Division of application No. 12/460,388, filed on Jul. 16, 2009, now Pat. No. 8,353,076.

(60) Provisional application No. 61/135,842, filed on Jul. 22, 2008.

(51) Int. Cl.
*A46B 5/00* (2006.01)

(52) U.S. Cl.
USPC ..... 15/172; 15/144.1; 15/144.3; 15/144.4; 15/176.6; 132/120; 132/150

(58) Field of Classification Search
USPC ..... 15/144.1, 144.3, 144.4, 172, 176.1, 15/176.6, 201, 202; 132/120, 148, 150, 132/226, 265
See application file for complete search history.

(56) References Cited

U.S. PATENT DOCUMENTS

| | | | | | |
|---|---|---|---|---|---|
| 287,187 | A | * | 10/1883 | Stanton | 15/144.4 |
| 1,501,547 | A | * | 7/1924 | Bassett | 15/144.3 |
| 1,951,023 | A | * | 3/1934 | Winsor | 15/244.1 |
| 2,113,206 | A | * | 4/1938 | Yakimchick | 15/27 |
| 2,173,437 | A | * | 9/1939 | Kataja | 15/144.1 |
| 2,184,827 | A | * | 12/1939 | Willmot | 15/144.4 |
| 2,641,012 | A | * | 6/1953 | Storrs | 15/144.4 |
| 3,690,331 | A | * | 9/1972 | Messer | 132/120 |
| 3,729,762 | A | * | 5/1973 | Roth | 15/176.6 |
| 4,377,013 | A | * | 3/1983 | Tuller | 15/25 |
| 4,475,563 | A | * | 10/1984 | Martin | 132/136 |
| 4,639,965 | A | * | 2/1987 | Suzuki | 15/104.002 |
| 4,987,633 | A | * | 1/1991 | Heneveld | 15/185 |
| 5,305,767 | A | * | 4/1994 | Ivanov | 132/151 |
| 5,479,951 | A | * | 1/1996 | Denebeim | 132/265 |
| 6,308,717 | B1 | * | 10/2001 | Vrtaric | 132/200 |
| D466,696 | S | * | 12/2002 | Van Dyk | D4/121 |
| 6,935,350 | B2 | * | 8/2005 | Nakamura | 132/144 |

FOREIGN PATENT DOCUMENTS

| | | | |
|---|---|---|---|
| FR | 2708439 | * | 2/1985 |
| WO | 86/05078 | * | 9/1986 |

* cited by examiner

*Primary Examiner* — Mark Spisich
(74) *Attorney, Agent, or Firm* — Sandra Lipkin

(57) ABSTRACT

A hair brush with a slideable brush head that allows the brush head to be positioned on either end of the elongated handle to thereby providing ease of use by both right handed or left handed users. The elongated handle has different ways thereon to arrest the brush head in any desired position. The brush head may also be removed from the handle, if so desired, so that a brush head of a different circumference but the same inner diameter may be used.

1 Claim, 5 Drawing Sheets

Fig. 1A
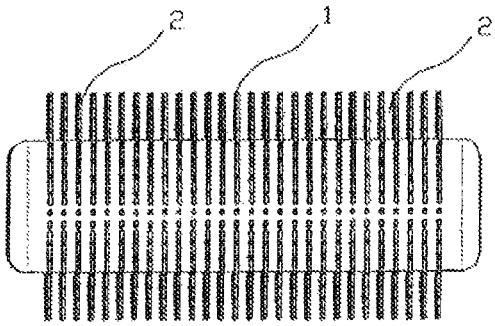
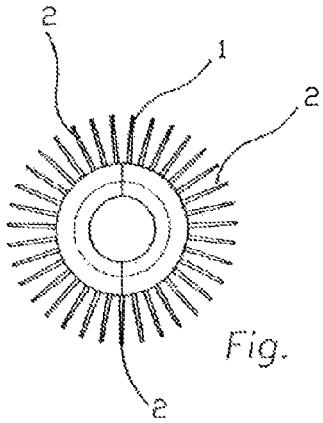
Fig. 1B
Fig. 1C
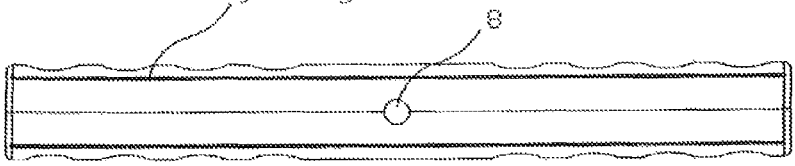
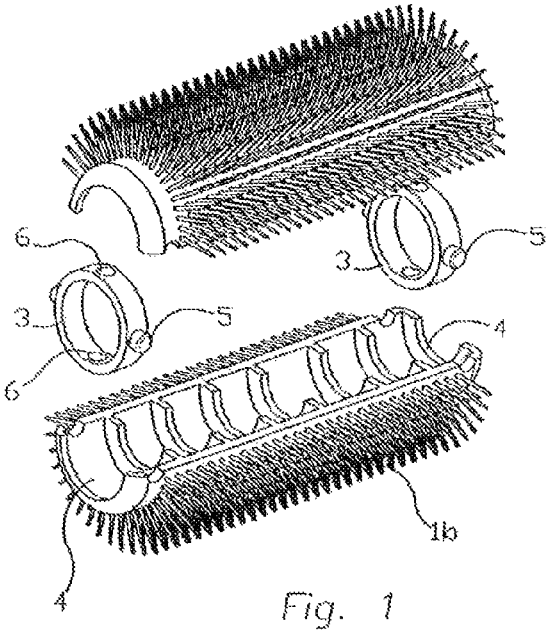
Fig. 1
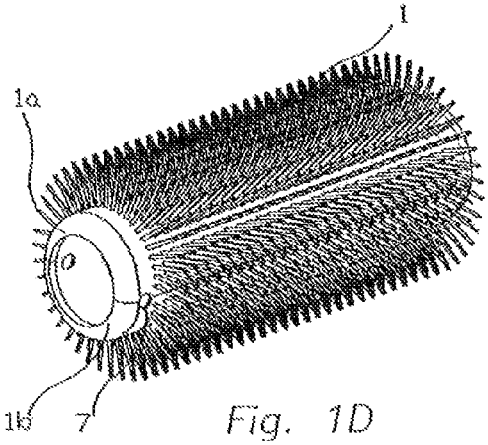
Fig. 1D

HAIR BRUSH WITH SLIDEABLE BRUSH HEAD

REFERENCE TO PRIOR APPLICATION

This application claims the priority of provisional application 61/135,842, filed Jul. 22, 2008 entitled HAIR BRUSH WITH SLIDEABLE BRUSH HEAD by Mary Asta and is a Divisional application of application Ser. No. 12/460,388, filed Jul. 16, 2009, now U.S. Pat. No. 8,353,076.

BACKGROUND OF THE INVENTION

The present invention relates, generally, to the field of hairbrushes, and specifically toward a hairbrush having elongated handles that can be used in different ways. Hairbrushes are extremely conventional for use in grooming hair as well in styling the hair. Typically, a hairbrush is constructed of a handle and a brush head having bristles thereon of varying thicknesses and stiffness for use with a variety of hair types to achieve various styles.

U.S. Pat. No. 1,951,023 discloses a brush including a handle having a mass of sponge rubber secured thereto. The handle is disclosed to be collapsible and is composed of two or more telescoping members one of which is embedded within the mass of the sponge rubber with an inner member being slideable into and out of an embedded member to form other convenient extending handles.

U.S. Pat. No. 2,641,012 illustrates a brush that has telescoping handle parts that form extendable sections of a hairbrush One part of the handle section has a larger diameter while other sections are progressively smaller whereby the various sections can telescope within each other to form a longer or shorter handle.

U.S. Pat. No. 3,690,331 discloses a combined brush and comb including a body having tufts on an exterior surface of the body and a comb that may be adjusted for various angles with respect to the body of the brush and included are retractable handles. In one embodiment the handles are extendible from either end of the brush body to facilitate its use by either a right-handed or a left-handed person.

BRIEF DESCRIPTION OF THE INVENTION

The inventive concept of the instant invention hereby disclosed is a specific hairbrush that includes a handle upon which a grooming roller can be moved from one end of the handle to the other depending on the needs of the beautician due to styling requirements or mere left- or right-handedness. The concept also allows for the grooming roller to be moved from end to the other, or removed altogether, during styling in order to provide a space for another hairbrush having a different circumferential size or different brushing elements as long as the inner diameter remains the same so as to conform to the outer diameter of the handle.

BRIEF DESCRIPTION OF THE DRAWINGS

FIG. 1A is a side view of the brush head of the instant invention.

FIG. 1B is a top view of the brush head of the instant invention.

FIG. 1C is a side view of the handle of the instant invention.

FIG. 1 is an exploded view of the brush head of the preferred embodiment of the instant invention.

FIG. 1D is the view show in FIG. 1, but intact and not exploded.

DETAILED DESCRIPTION OF THE INVENTION

Figure 2A:
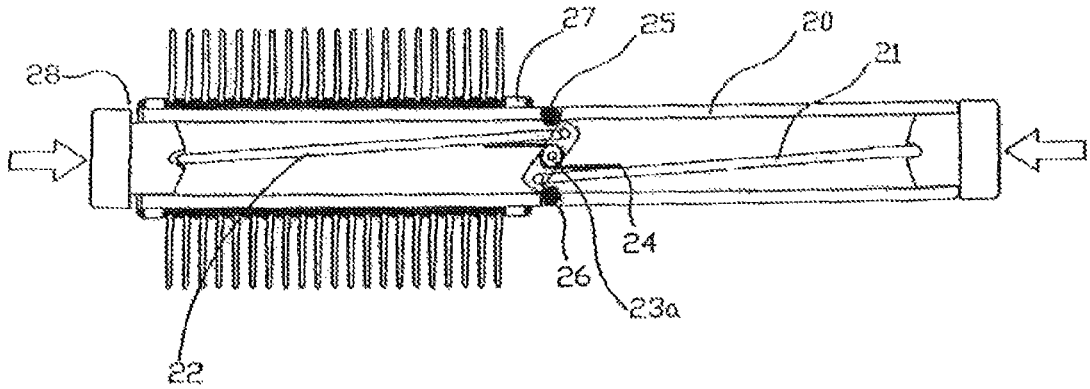
FIG. 2A is a cross-sectional side view of an alternate embodiment of the instant invention.

FIGS. 1A-1D illustrate a first embodiment that discloses a hair brush having hair brush head 1 with bristles 2 thereon. The hair brush head 1 consists of two halves 1*a*, 1*b* that form an internal chamber that can snugly house an elongated slideable handle 9 that can move the brush head 1 from one end of the handle 9 to the other and can be locked thereat. The two halves of the brush 1 have contained therein in a groove 4 at either end a flexible ring 3. The flexible ring 3 has push buttons 5 which, when the two halves 1*a*, 1*b* are assembled, fit in a hole 7 formed by the two halves 1*a*, 1*b*. The flexible ring 3 further has two inwardly directed arrest buttons 6. The operation of this embodiment is such that if the brush head 1 is located on one end of the handle and locked into place by the arrest buttons 6 after having penetrated into the openings 8 in the handle, the operator merely has to push the two push buttons 5 inwardly thereby flexing the ring 3, which will then release the two arrest buttons 6 from the holes or opening 8 in the handle 9, and the brush head 1 can be moved to the other end of the handle 9. When the pressure on the push buttons 5 is released, the two arrest buttons on the other end of the brush head 1 will settle back again into the holes 8 on the handle 9 and the brush head 1 will be relocated to the other end of the handle.

Figure 2B:
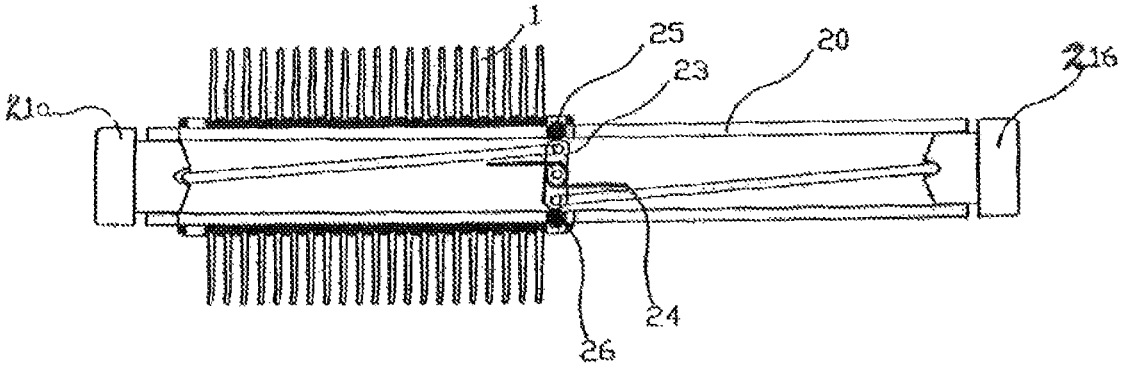
FIG. 2B is similar to FIG. 2A, but with the mechanism activated.

FIGS. 2A and 2B show a second embodiment of how a brush head 1 can be locked in place at either end of a handle 20. In this embodiment there are shown two end push buttons 21*a* and 21*b* at either end of the handle 20. Each one of the push buttons 21*a*, 21*b* is connected to activating rods 21, 22. Each inner end of the activating rods 21 and 22 are now connected to a rotating lever 23, which can rotate around a pin 23*a* in the inner confines of the handle 20. The outer ends of the rotating lever 23 keep balls 25, 26 at an opening in the hair brush head 1 in an arrested position. The rotating lever 23 is kept in this position and in contact with the balls 25, 26 by a coil spring 24. When it is desired to move the brush head 1 from one end of the handle 20 to the other, it is merely up to the operator to push one of the end push buttons 21*a*, 21*b* inwardly, thereby activating the respective rod 21, 22 causes the rotating lever 23 to rotate to some extent and, whereby, the pressure on the balls 25, 26 will be released and the brush head 1 can be moved. Upon release of the pressure from either push button 21*a*, 21*b*, the balls 25, 26 will again lock into an opening at the end of the brush head 1 and lock the same into place because of the resetting of the lever 23.

Figure 3:
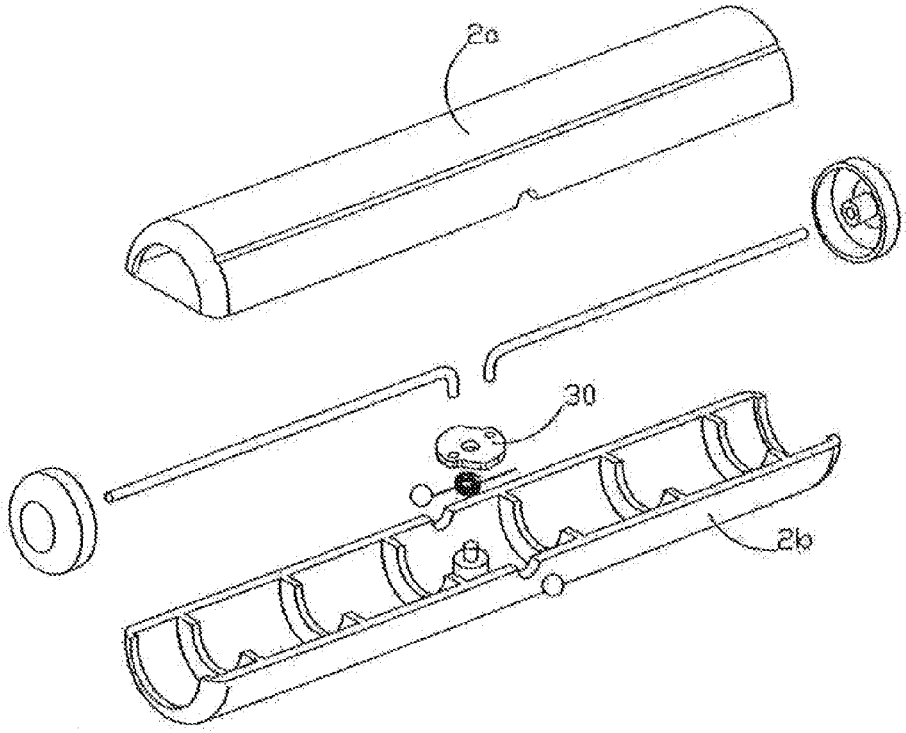
FIG. 3 is an exploded view of a second alternate embodiment of the instant invention.
Figure 3A:
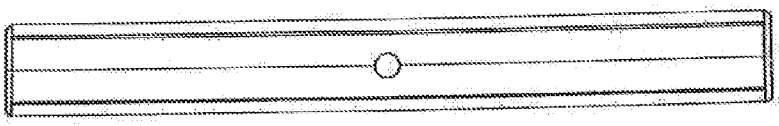
FIG. 3A is a side view of the handle of the second alternate embodiment of the instant invention.
Figure 3B:
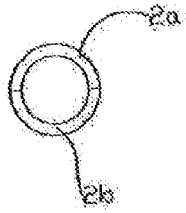
FIG. 3B is a top view of the handle of the second alternate embodiment of the instant invention.
Figure 3C:
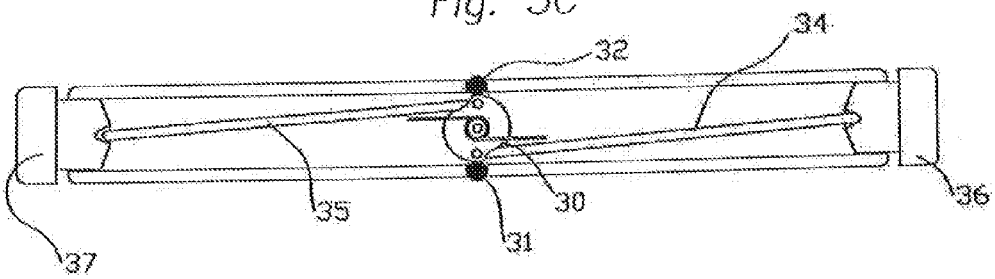
FIG. 3C is a cross sectional view of the handle of the second alternate embodiment of the instant invention.
Figure 3D:
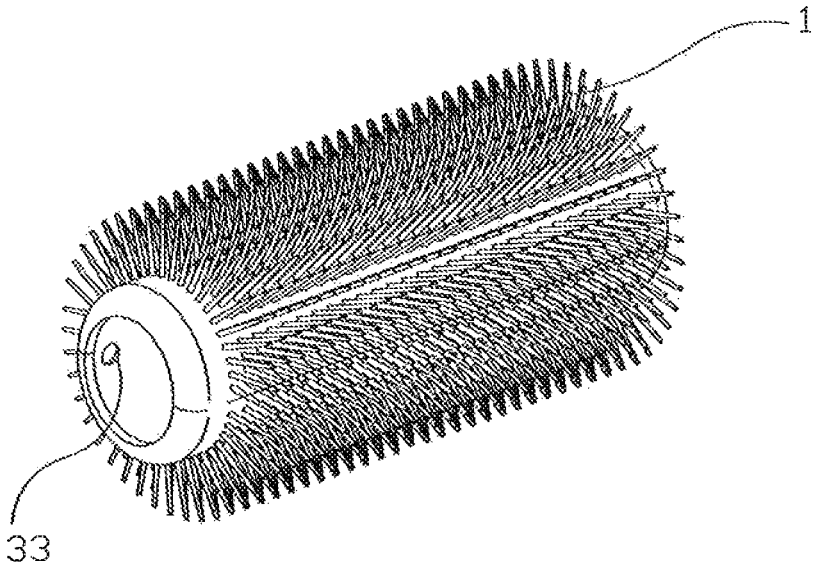
FIG. 3D is a perspective view of the brush head of the second alternate embodiment of the instant invention.

FIGS. 3-3D illustrate a similar embodiment as was explained with regard to FIGS. 2A-2B. At either end of the hollow handle halves 2*a* and 2*b* there are again two push buttons 36, 37 which again, like in FIG. 2, each operate on an activating rod 34, 35. The ends of each of the activating rods 34, 35 are connected to a rotating disc which has dimples at its outer periphery to accept two arresting balls 31, 32. In an activated position the two balls will enter two openings at the ends of the brush head 1 to lock it in place. Again, as explained in FIG. 2A-2B, there is a coil spring (not shown) that keeps the disc in an activated position and thereby the balls 31, 32 in a locked position. Upon pushing either one of the push buttons 36, 37, the respective activating rod 34, 35 will rotate the disc 30 and take the balls 31, 32 out of engagement with one of the holes 33, (seen in FIG. 3D, at the end of the brush head 1) and the brush head 1 can now be moved to the other end of the handle 20.

Figure 4:
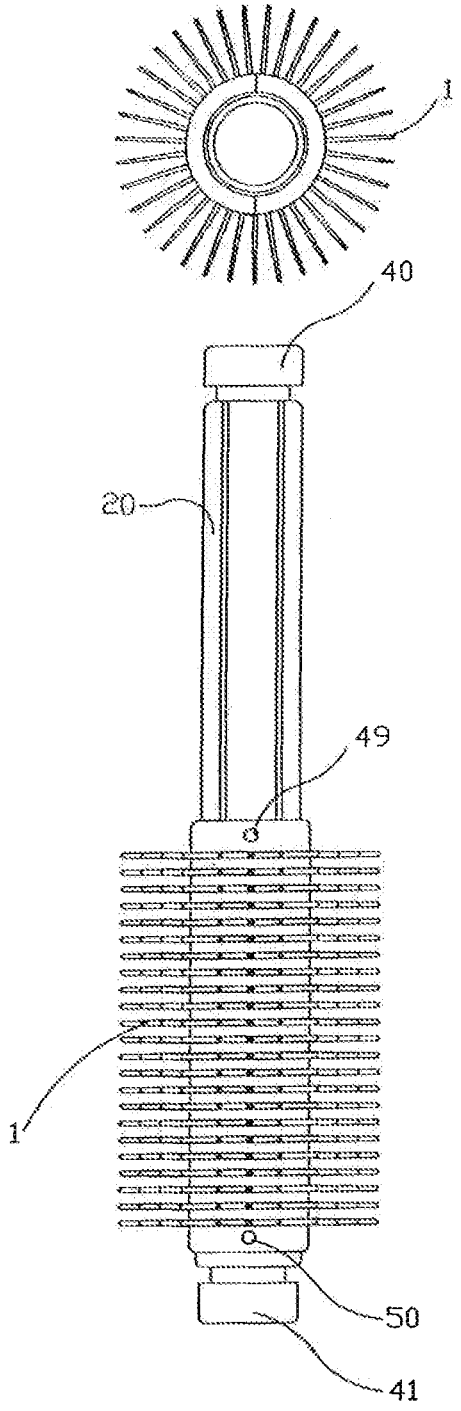
FIG. 4 is a side view of the third alternate embodiment of the instant invention.
Figure 4A:
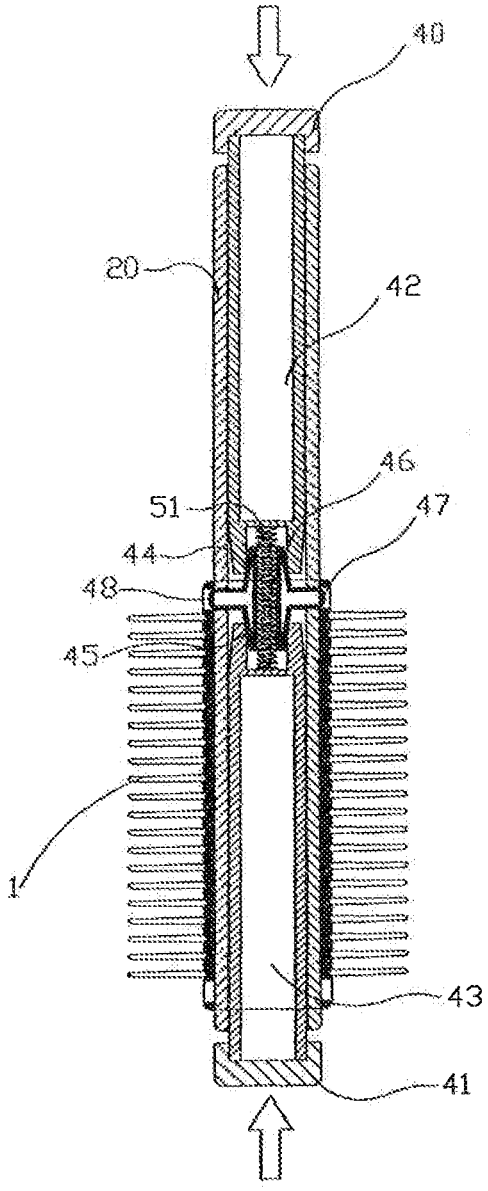
FIG. 4A is a cross sectional side of the third alternate embodiment of the instant invention.

FIG. 4 illustrates still another embodiment of how a brush head 1 can be moved to the other end of the handle 20. At both ends of the handle 20 there are two respective push buttons 40, 41. Each one of the push buttons 40, 41 is connected to a respective sliding sleeve 42, 43. Each of the sliding sleeves 42, 43 have a sleeve-like end at their inner ends. In the middle of the interior of the hollow handle there is located a flexible activating element 45 that has camming surfaces 44, 46 at its outer ends. The camming surfaces 44, 46 can be overridden or overlapped by each of the sleeve-like inner ends of the sliding sleeves 42, 43. A centering spring 51 is located inside the flexible activating element 45 and also extends to the insides of each of the sliding sleeves 42, 43. The flexible activating element 45 has two outwardly extending protrusions 47, 48 which normally are engaged with arresting holes 49, 50 at each of the ends of the brush head 1. When it is desired to move the brush head 1 from one end of the elongated handle 2 to the other end, the operator can push either push button 40 or 41 whereby either sliding sleeve 42, 43 with its sleeve-like inner end will ride over either the camming surfaces 44, 46 of the flexible activating element 45 to thereby distort the flexible activating element 45 and take the protrusions 47, 48 out of engagement with the arresting holes 49, 50 at either end of the brush head 1 and release the same to be moved to the other end of the handle 20.

The rollers can also contain a head-conducting material, such as copper, to allow the rollers on the brush to act like hot rollers when used with a heat source, such as a blow dryer.

The discussion included in this patent is intended to serve as a basic description. The reader should be aware that the specific discussion may not explicitly describe all embodiments possible and alternatives that are implicit. Also, this discussion may not fully explain the generic nature of the invention and may not explicitly show how each feature or element can actually be representative or equivalent elements. Again, these are implicitly included in this disclosure. Where the invention is described in device-oriented terminology, each element of the device implicitly performs a function. It should also be understood that a variety of changes may be made without departing from the essence of the invention. Such changes are also implicitly included in the description. These changes still fall within the scope of this invention.

Further, each of the various elements of the invention and claims may also be achieved in a variety of manners. This disclosure should be understood to encompass each such variation, be it a variation of any apparatus embodiment, a method embodiment, or even merely a variation of any element of these. Particularly, it should be understood that as the disclosure relates to elements of the invention, the words for each element may be expressed by equivalent apparatus terms even if only the function or result is the same. Such equivalent, broader, or even more generic terms should be considered to be encompassed in the description of each element or action. Such terms can be substituted where desired to make explicit the implicitly broad coverage to which this invention is entitled. It should be understood that all actions may be expressed as a means for taking that action or as an element which causes that action. Similarly, each physical element disclosed should be understood to encompass a disclosure of the action which that physical element facilitates. Such changes and alternative terms are to be understood to be explicitly included in the description.

What I claim is:

1. A hair grooming device comprising:

a brush head that is substantially cylindrical, having a first end and a second end and haying a hollow center;

an elongated handle having an exterior, an interior, a first end and a second end wherein said brush head is movable between said first end of said elongated handle and said second end of said elongated handle;

means for arresting said brush head at either end of said elongated handle wherein said means for arresting includes two push buttons at each end of said elongated handle, said push buttons being connected to activating rods having a first end and a second end, said activating rods extending into said interior of said elongated handle and wherein said ends of said activating rods are connected to a centrally located disc, said disc having dimples at a periphery thereof, said dimples having arresting balls located at said periphery, said arresting balls entering holes located at either end of said brush head to arrest said brush head at either end of said elongated handle; and means for biasing said disc into locking position relative to said brush head wherein said means for biasing is a coil spring.

* * * * *